US006622698B2

(12) United States Patent
Hayashida

(10) Patent No.: US 6,622,698 B2
(45) Date of Patent: Sep. 23, 2003

(54) THROTTLE VALVE CONTROL UNIT AND MANUFACTURING METHOD THEREOF

(75) Inventor: Tsuguhisa Hayashida, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/265,042

(22) Filed: Oct. 3, 2002

(65) Prior Publication Data

US 2003/0075149 A1 Apr. 24, 2003

(30) Foreign Application Priority Data

Oct. 18, 2001 (JP) ..... 2001-320423

(51) Int. Cl.[7] ..... F02D 9/10
(52) U.S. Cl. ..... 123/399
(58) Field of Search ..... 123/399, 361, 123/337

(56) References Cited

U.S. PATENT DOCUMENTS

| | | | | |
|---|---|---|---|---|
| 5,672,818 A | | 9/1997 | Schaefer et al. | 73/118.2 |
| 6,070,852 A | | 6/2000 | McDonnell et al. | 251/129.11 |
| 6,279,535 B1 | | 8/2001 | Matsusaka | 123/399 |
| 6,341,593 B2 | * | 1/2002 | Kamimura et al. | 123/337 |
| 6,488,010 B2 | * | 12/2002 | Saito et al. | 123/399 |

FOREIGN PATENT DOCUMENTS

| | | | | |
|---|---|---|---|---|
| DE | 4431455 | * | 3/1996 | F02D/9/00 |
| EP | 0844378 | | 5/1998 | |
| EP | 1108986 | | 6/2001 | |
| EP | 1167724 | * | 1/2002 | F02D/9/10 |
| WO | WO00/58614 | | 5/2000 | |

OTHER PUBLICATIONS

"Control System of Internal Combustion Engine," Patent Abstract of Japan, Publication No. 04066736, Publication Date: Mar. 3, 1992, 1 page.

* cited by examiner

*Primary Examiner*—Hieu T. Vo
*Assistant Examiner*—Hai Huynh
(74) *Attorney, Agent, or Firm*—Beyer Weaver & Thomas LLP

(57) ABSTRACT

A throttle valve control unit that can easily be assembled and has a simple molding die structure, and a manufacturing method thereof are provided. There are a container shaped casing, a rotation detection portion provided at the outer surface of the casing, a sensor terminal led from the rotation detection portion, exposed in a connector housing provided at the casing by insert-molding, a motor feeding terminal with an exposed portion provided in parallel with the sensor terminal, having its one end exposed in the connector housing by insert molding, and its other end having an exposed portion extended into the casing, and a separate motor feeding conductor attached in the casing. One end of the motor feeding conductor is connected with the exposed portion and the motor terminal as it is held between a pair of first folded portions provided at the other end of the motor feeding conductor.

5 Claims, 4 Drawing Sheets

THROTTLE VALVE CONTROL UNIT AND MANUFACTURING METHOD THEREOF

BACKGROUND OF THE INVENTION

1. Field of the Invention

A throttle valve control unit according to the invention relates to a unit to control the opening/closing of a throttle valve in a vehicle.

2. Description of the Prior Art

Among the drawings of the conventional throttle valve control unit according to the embodiment, FIG. 5 is a sectional view of an essential part of the conventional throttle valve control unit, and FIG. 6 is a plan view of a casing for the conventional throttle valve control unit.

A throttle valve tube 31 made of a metal has a tubular shape and lets an air-fuel mixture pass therethrough.

A throttle valve 32 made of a metal in a disc shape opens/closes the passage of the throttle valve tube 31 and is integrally formed with a throttle valve shaft 33 located across the center of the disc of the throttle valve 32.

A pair of bearings 34, 34 are buried in the tube wall 35 of the throttle valve tube 31 and support the throttle valve shaft 33 at both ends.

A connection chamber 36 adjacent to the throttle valve 32 is provided in a space in which the throttle valve shaft 33 is projected through one of the bearings 34.

Three transmission gears 37, 38, and 39 are engaged with each other, and the throttle valve shaft 33 is fixed at the center hole of the transmission gear 37 at one end of the arrangement of the three transmission gears 37, 38 and 39, so that the transmission gear rotates the throttle valve 32. The three transmission gears 37, 38, and 39 are provided in the connection chamber.

A slider 40 is made of a resilient metal material, and attached to a sidewall of the transmission gear 37 which has its center fixed at the throttle valve shaft 33.

A motor 41 is stored in a rectangular housing 41*a* and fixed at the tube wall 35 of the throttle valve tube 31 and has its motor terminal 41*b* and its motor shaft 41*c* projected. The motor shaft 41*c* of the motor 41 is fitted into the center hole of the gear 39 at the other end of the arrangement of the three transmission gears 37, 38, and 39. More specifically, the rotation of the motor 41 rotates the throttle valve shaft 33 through the three transmission gears 37, 38, and 39. The motor 41 is provided in the connection chamber 36.

A casing 42 made of insulating resin has a container shape whose outer shape is substantially elliptical. The casing 42 is attached to cover the connection chamber 36 from the outside, and covers the motor 41, the transmission gears 37, 38 and 39, and the slider 40.

A resistance substrate 43 that is insulating and in a U-shape has conductive paths 44 on the surface, and is provided at one end of the casing 42. When the casing 42 is mounted over the connection chamber 36, the conductive paths 44 of the resistance substrate 43 slide into contact with the sliders 40 attached at the sidewall of the transmission gear 37.

A sensor terminal 45 made of a metal conductor in a strip shape has one end connected to the conductive path 44 at the resistance substrate 43. The sensor terminal 45 is formed together with the casing 42 by insert molding, and therefore is buried in the insulating resin of the casing 42 except for a surface.

A motor feeding terminal 46 is a strip shaped metal conductor, one end of which is raised upward as a clip shaped motor feeding portion 46*a* from the bottom of the casing 42 compared to the other part of the motor feeding terminal 46. The motor feeding terminal 46 is formed together with the casing by insert molding, and therefore buried in the insulating resin of the casing except for the motor feeding portion 46*a*. When the casing 42 is mounted over the connection chamber 36, the motor terminal 41*b* and the motor feeding portion 46*a* are connected.

A connector housing 47 made of insulating resin has a recessed portion and is integrally formed with the casing 42. The sensor terminals 45 and the motor feeding terminals 46 gather at the connector housing 47 for connection with external connectors.

A method of manufacturing a conventional throttle valve control unit will now be described. To begin with, the casing 42 and the connector housing 47 are formed by insert-molding integrally with the sensor terminals 45 and the motor feeding terminals 46, and at the same time, the clip-shaped motor feeding portion is formed and worked. In this way, the sensor terminals 45 and the motor terminals 46 formed at the bottom of the casing 42 are gathered at the connector housing 47, so that their ends are exposed. Then, the resistance substrate 43 is attached and fixed to one end of the casing 42 so that the ends of the conductor paths 44 and the sensor terminals are connected. In a separate step, the throttle valve 32, the bearings 34, and the throttle valve shaft 33 are attached to the throttle valve tube 31, and a motor is attached in the connection chamber 36. The transmission gears 37, 38, and 39 are provided so that the gear 37 at one end of the arrangement of the gears 37, 38, and 39 has its center fixed to the throttle valve shaft 33, and the gear 39 at the other end has its center hole fixed to the motor shaft 41*c*. Then, the sliders 40 are attached to a side surface of the transmission gear 37 at the said one end. Finally, the assembled casing 42 is placed to cover the connection chamber, and the casing 42 is rigidly mounted to the unit assembled in the throttle valve tube in the above separate step. At the time, the clip-shaped motor feeding portion 46*a* on the side of casing 42 is engaged with the motor terminal 41*b*, while the conductive paths 44 of the resistance substrate 43 are in contact with the sliders 40 attached at the side surface of the transmission gear 37. In this way, the conventional throttle valve control unit is completed.

In the above conventional throttle valve control unit and the manufacturing method thereof, there is a connection portion to the motor terminal whose tip end is in a complicated, clip shape, and the connection portion is raised from the casing compared to the other part. The other part must therefore be distributed over the casing. The motor feeding terminal in this shape must be formed integrally with the casing by insert molding, which makes the molding die structure complicated.

SUMMARY OF THE INVENTION

It is therefore an object of the invention to provide a throttle valve control unit having a simple molding die structure and a manufacturing method thereof.

A throttle valve control unit according to the invention includes a container shaped casing, a rotation detection portion provided at the inner surface of the casing, a sensor terminal led from the rotation detection portion, exposed in a connector housing provided at the outer surface of the casing and held at the casing by insert-molding, a motor feeding terminal provided in parallel with the sensor terminal, having its one end exposed in the connector housing and held at the casing by insert molding, and its other end having an exposed part extended into the casing, and a motor feeding conductor provided separately from the motor feeding terminal and attached in the casing. One end of the motor feeding conductor is connected with the exposed part of the motor feeding terminal, and connected with a motor terminal as it is held between a pair of first folded portions provided at the other end of the motor feeding conductor. The motor feeding terminal is powered to drive a motor through the motor feeding conductor, the motor shaft of the motor rotates the throttle valve shaft to open/close the throttle valve, and the opening/closing angle of the throttle valve is detected based on the rotation transmitted to the rotation detection portion through the throttle valve shaft.

In this way, the motor feeding conductor provided separately from the motor feeding terminal is used, and this motor feeding conductor does not have to be formed integrally with the other motor feeding terminal, which simplifies the molding die structure.

One end of the motor feeding conductor is resiliently connected to the exposed portion by the second folded portion.

In this way, the connection is established only by inserting the second folded portion, in other words, the connection can simply be made.

A third folded portion is provided adjacent to the second folded portion, and the third folded portion is made into a bending portion formed between the second folded portion and an opposing wall.

In this way, the third folded portion serves as a bending portion to eliminate the effect of expansion or contraction of the casing upon the connection by the second folded portion.

The casing is provided with a pair of guide columns having a recessed portion to support the pair of first folded portions.

In this way, the first folded portion has its position surely fixed, which ensures the connection.

A method of manufacturing a throttle valve control unit according to the invention includes the steps of:

forming a sensor terminal and a motor feeding terminal at a container shaped housing by insert-molding so that the terminals each have one end exposed in a tubular connector housing and the other end exposed at the inner surface of the casing, the container shaped housing having a storing portion storing the connector housing and a resistance substrate, storing the resistance substrate fixedly in the storing portion and connecting the resistance substrate to the other end of the sensor terminal, mounting a slider retainer provided with a slider member in the storing portion in a rotatable manner, the slider member sliding on the resistance substrate, fixing at the bottom of the casing a motor feeding conductor having a pair of first folded portions at one end and a second folded portion resiliently connected to the other end of the motor feeding terminal on the other end, thereby connecting the second folded portion to the other end of the motor feeding terminal, resiliently connecting a motor terminal to the first folded portion, and coupling a throttle valve shaft to the slider retainer.

According to the method, the motor feeding conductor separate from the motor feeding terminal is used, and therefore the molding die structure can be simplified.

DESCRIPTION OF THE PREFERRED EMBODIMENTS

Figure 1:
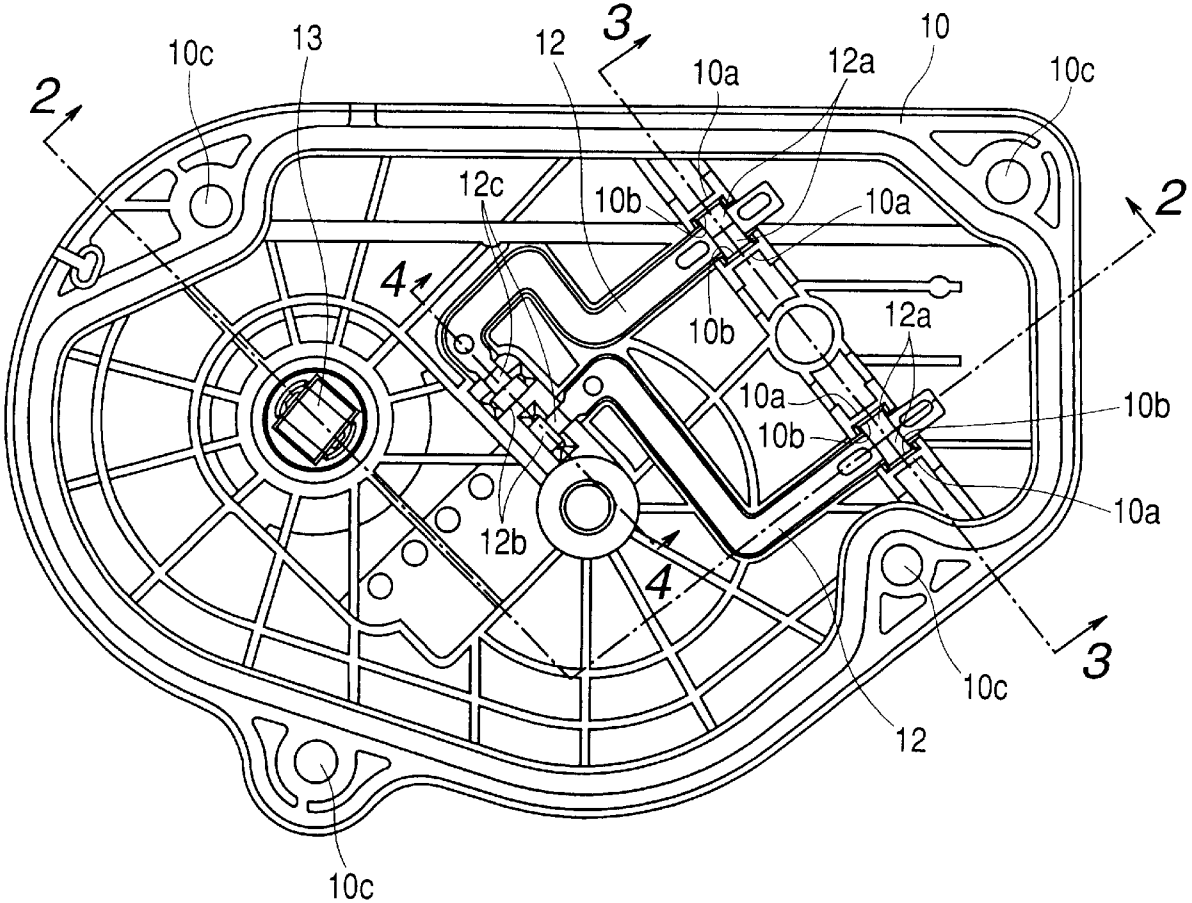
FIG. 1 is a plan view of a casing for a throttle valve control unit according to an embodiment of the invention.
Figure 2:
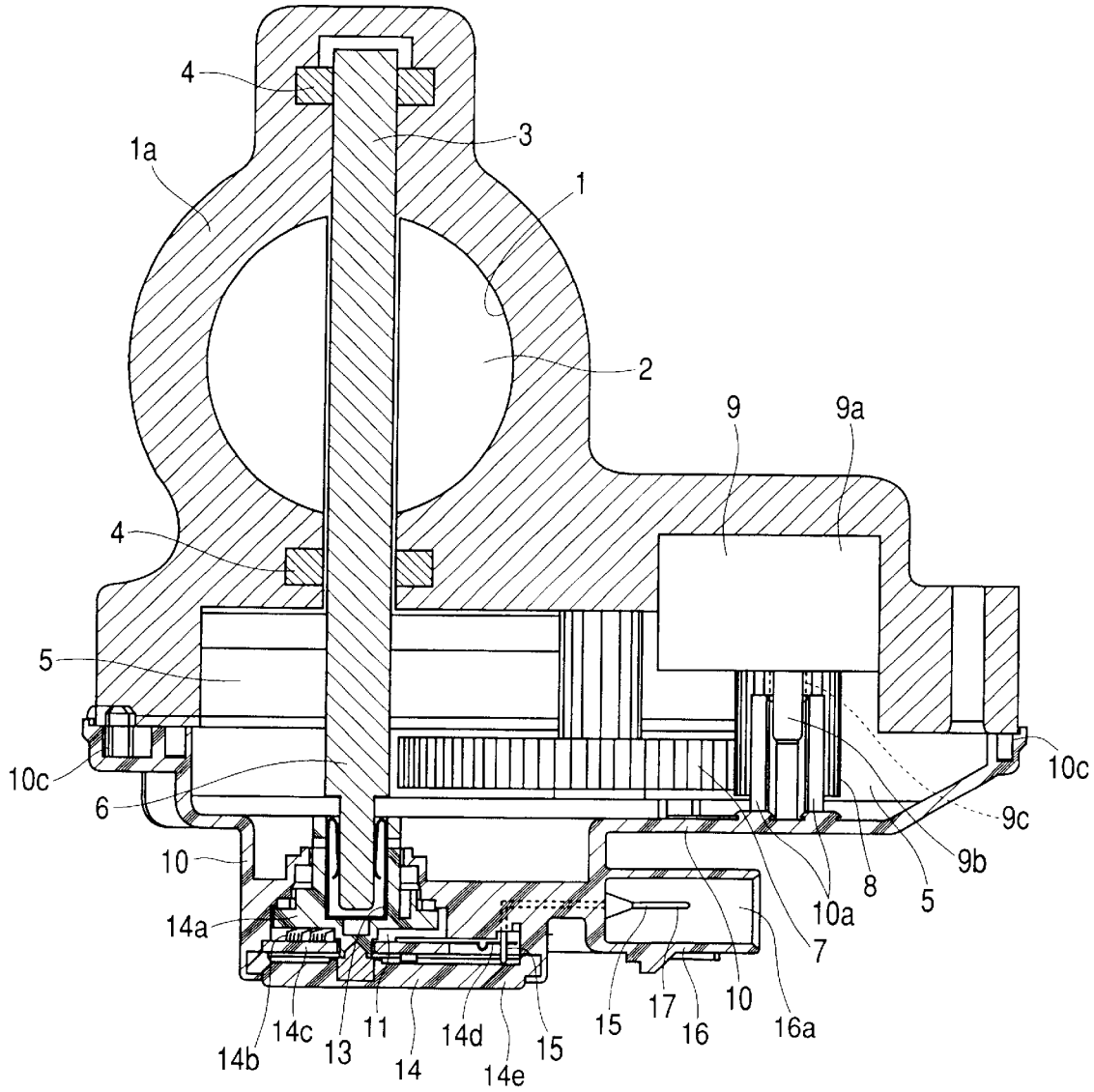
FIG. 2 is a sectional view of a part of the throttle valve control unit according to the embodiment having the casing incorporated, taken along line 2—2 in FIG. 1.
Figure 3:
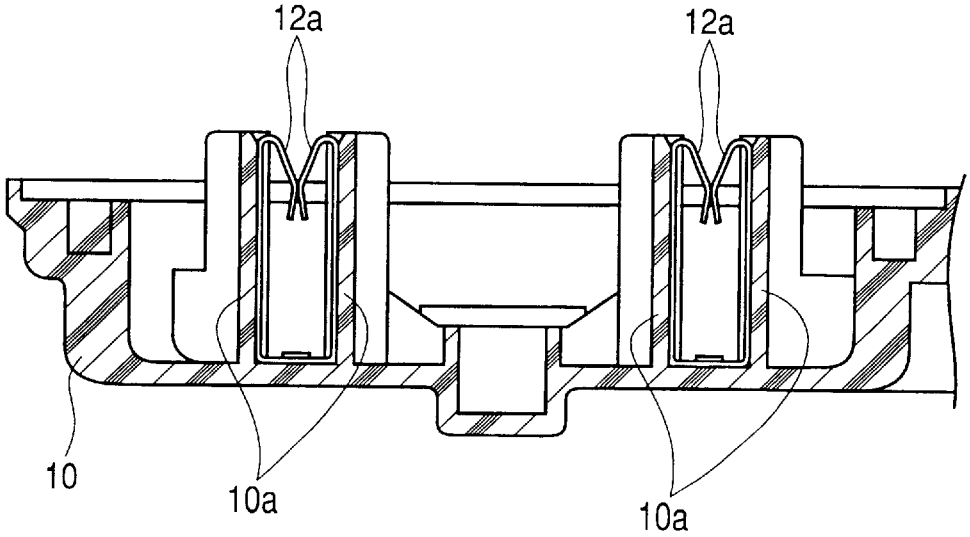
FIG. 3 is a sectional view taken along line 3—3 in FIG. 1.
Figure 4:
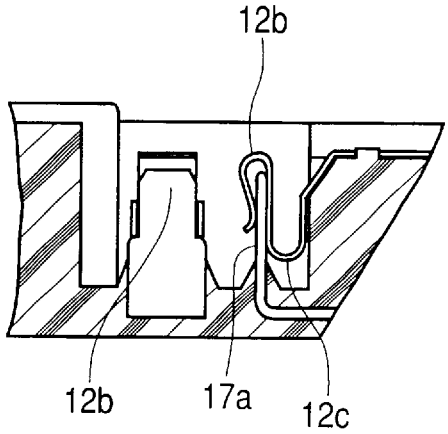
FIG. 4 is a sectional view taken along line 4—4 in FIG. 1.
Figure 5:
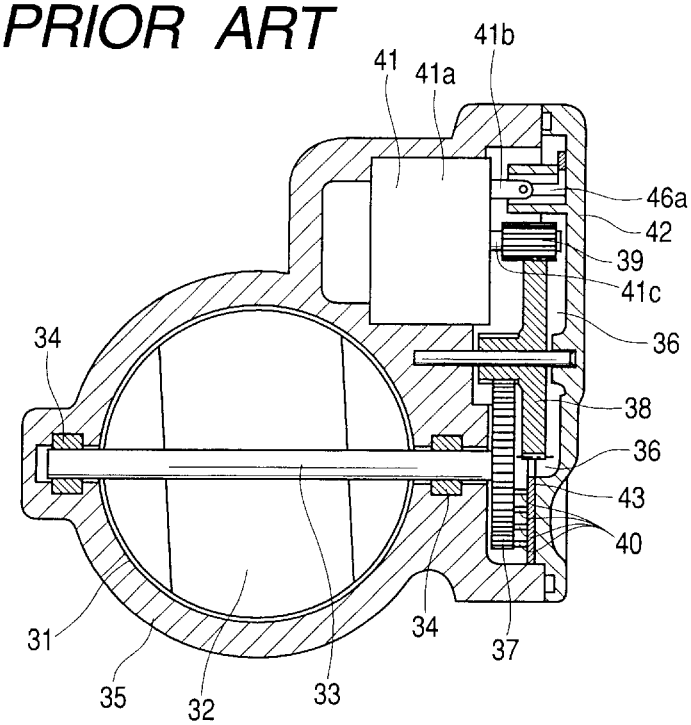
FIG. 5 PRIOR ART
FIG. 5 is a sectional view of an essential part of a conventional throttle valve control unit.
Figure 6:
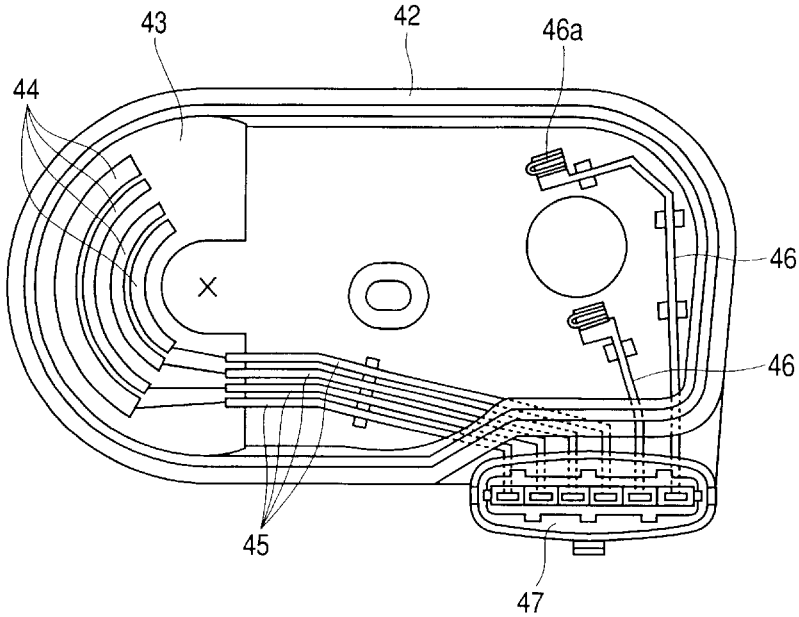
FIG. 6 PRIOR ART
FIG. 6 is a plan view of a casing for a conventional throttle valve control unit.

Among the drawings of a throttle valve control unit according to an embodiment of the invention, FIG. 1 is a plan view of a casing for the throttle valve control unit according to the embodiment of the invention, FIG. 2 is a sectional view of a part of the throttle valve control unit according to the embodiment having the casing incorporated, taken along line 2—2 in FIG. 1, FIG. 3 is a sectional view taken along line 3—3 in FIG. 1, and FIG. 4 is a sectional view taken along line 4—4 in FIG. 1.

A throttle valve tube 1 made of a metal has a tubular shape and lets an air-fuel mixture pass therethrough.

A throttle valve 2 made of a metal in a disc shape opens/closes the passage of the throttle valve tube 1 and has a throttle valve shaft 3. The throttle valve shaft 3 is located across the center of the disc of the throttle valve 2 and integrally formed with the throttle valve 1. The throttle valve shaft is provided with gear teeth near its tip end, which serves as a gear.

A pair of bearings 4, 4 are buried in the tube wall 1*a* of the throttle valve tube, and support the throttle valve shaft 3 in two positions.

A connection chamber 5 is located outside the bearings 4, 4 for the throttle valve shaft 3 and in the space into which the throttle valve shaft projects.

Three transmission gears 6, 7, and 8 engage with each other, and the transmission gear 6 at one end is formed by providing the throttle valve shaft 3 with gear teeth at the end, and opens/closes the throttle valve by the rotation of the transmission gear at the other end. The three transmission gears 6, 7, and 8 are provided in the connection chamber.

A motor 9 stored in a rectangular housing 9*a* is provided in the connection chamber 5, and fixed to the part integrally extended from the tube wall 1*a* of the throttle valve tube 1, so that the motor terminal 9*b* and the motor shaft 9*c* are projected. The motor shaft 9*c* is fitted into the center hole of the gear 8 at the other end of the arrangement of the three transmission gears 6, 7, and 8. More specifically, the rotation of the motor rotates the throttle valve shaft 3 through the three transmission gears 6, 7, and 8, so that the throttle valve 2 is opened/closed.

A container shaped casing 10 is made of insulating resin and in a substantially elliptical shape. The casing 10 is attached to a fixing portion 10*c* at the extension of the tube wall 1*a* of the throttle valve tube 1 so as to cover the motor 9, and the three transmission gears 6, 7, and 8 from the outside. The casing thus covers the motor 9, and the three transmission gears 6, 7, and 8 and forms the connection chamber 5. There is a storing portion 11 at the bottom of the casing 10.

Two motor feeding conductors 12, 12 are made of a metal conductor and each have a first folded portion 12*a* at one end, and a second folded portion 12*b* at the other end. The first folded portions 12*a* are provided in pairs. The motor terminal 9*b* is held and connected between a pair of first folded portion 12*a*. As shown in FIG. 3, a pair of first folded portions 12*a* are supported at the recessed portion 10*b* at the supporting columns 10*a* raised upright from the bottom of the casing 10. The second folded portion 12*b* has an adjacent third folded portion 12*c*. The motor feeding conductor 12 as a whole is fixed to the casing by caulking through a caulking portion.

A rotation transmission portion 13 is made of a U-shaped metal piece, and provided exposed at the bottom of the casing 10. The tip end of the throttle valve shaft 3 is fitted into the rotation transmission portion 13, and the rotation of the throttle valve shaft 3 is transmitted to the rotation transmission portion 13.

A rotation detection portion 14 includes a slider retainer 14*a*, a slider member 14*b*, a resistance substrate 14*c*, a lid 14*e* and the like.

The slider retainer 14*a* is made of insulating resin and has its disc portion projected from the lower end of the cylinder. The slider retainer 14*a* is provided in the storing portion 11 at the bottom of the casing 10. The slider retainer 14*a* is engaged with the rotation transmission portion 13, and the rotation of the rotation transmission portion 14 is transmitted to the slider retainer 14*a*.

The slider member 14*b* is made of a resilient metal material and attached to the slider retainer 14*a* so that the member can rotate together with the slider retainer 14*a*. Therefore, the slider member 14*b* rotates according to the rotation of the throttle valve shaft 3. The slider member 14*b* is provided in the storing portion 11 at the bottom of the casing 10.

The resistance substrate 14*c* is provided with a conductor path (not shown) on the surface, and a leading terminal 14*d* is provided at the end and stored in the storing portion 11 at the bottom of the casing 10. The slider member 14*b* slides on the conductor path of the resistance substrate 14*c* and extracts data related to the opening/closing angle of the throttle valve shaft.

The lid 14*e* made of a insulating resin plate in a substantially rectangular shape covers the storing portion 11 at the bottom of the casing 10 from the lower side, and is fixed to the bottom of the casing 10 by caulking.

A sensor terminal 15 made of a metal conductor is connected with the leading terminal 14*d* of the resistance substrate 14*c* and extended to the bottom of the casing 10.

A connector housing 16 has an insulating resin recessed portion 16*a* located at a side of the storing portion 11 at the bottom of the casing, and the sensor terminal 15 connected with the leading terminal 14*d* of the resistance substrate 14*c* is exposed at the recessed portion 16*a*.

The motor feeding terminal 17 made of a metal conductor has an end exposed at the recessed portion 16*a* of the connector housing 16 in parallel with the sensor terminal 15 by insert-molding. The other end is exposed at the bottom of the casing 10 and forms an exposed portion 17*a*. As shown in FIG. 4, the exposed portion 17*a* of the motor feeding terminal 17 is in connection with the second folded portion 12*b* of the motor feeding conductor 12. The second folded portion 12*b* holds the straight part that is the exposed portion 17*a* of the motor feeding terminal 17 between the fold. At the time, the third folded portion 12*c* adjacent to the second folded portion 12*b* is bent to stretch the bend of the second folded portion 12*b* and attached to the opposing wall raised from the bottom of the casing 10. Therefore, the third folded portion 12*c* serves as a bending portion to eliminate the effect of expansion or contraction of the casing upon the connection by the second folded portion 12*b*. In this way, power supplied to the motor feeding terminal 17 is transmitted to the first folded portion 12*a* of the motor feeding conductor 12 via the second folded portion 12*b*, so that the motor terminal 9*b* is fed.

A method of manufacturing the throttle valve control unit will now be described. To begin with, the tubular connector housing 16 and the storing portion 11 for storing the resistance substrate 14*c* are integrally formed at the outer side surface of the casing 10 together with the sensor terminal 15 and the motor feeding terminal 17 by insert-molding. The slider retainer 14*a* having the slider member 14*b* is fitted with the rotation transmission portion 13. The slider retainer 14*a* is mounted rotatably in the storing portion 11 as the rotation transmission portion 13 is exposed in the casing 10. Then, the resistance substrate 14*c* is stored and fixed in the storing portion 11 so that the slider member 14*b* is in contact with the resistance substrate 14*c* and the resistance substrate 14*c* and the sensor terminal 15 exposed in the storing portion 11 are connected. At the time, the other end of the sensor terminal 15 is exposed in the recessed portion 16*a* of the connector housing 16. Then, the storing portion 11 is sealed by the lid 14*e*. The motor feeding conductor 12 is fixed at the bottom of the casing 10 by caulking. The exposed portion 17*a* of the motor feeding terminal 17 placed in parallel with the sensor terminal 15 in the recessed portion 16*a* of the connector housing 16 and having its inner end exposed in the casing 10 and one end of the motor feeding conductor 12 are connected through the second folded portion 12*b*.

In a separate step, the throttle valve 2, the bearings 4, 4, and the throttle valve shaft 3 are attached to the throttle valve tube 1, while the motor 9 is mounted in the connection chamber 5. The center hole of the gear 8 at one end of the arrangement of the transmission gears 6, 7, and 8 is fixed to the motor shaft 9*c*, and the transmission gears 6, 7, and 8 are mounted in the connection chamber 5. Finally, the connection chamber 5 is covered with the thus assembled casing 10, and the casing 10 is mounted and fixed to a unit assembled in the throttle valve tube 1 in the above separate step. At the time, the motor feeding conductor 12 and the motor terminal 9*b* are connected as the motor terminal 9*b* is held between the pair of first folded portions 12*a* provided at the other end of the motor feeding conductor 12. At the same time, the tip end of the throttle valve shaft 3 is coupled with the rotation transmission portion 13, and the rotation is transmitted to the slider retainer 14*a*. In this way, the throttle valve control unit according to the invention is completed.

According to the embodiment, the exposed portion at both ends of the motor feeding terminal 17 has a plate shape that extends in the perpendicular direction from the insulating resin portion. Therefore, the dies for insert molding do not have to have a complicated shape. A portion in a complicated shape for resilient connection with the motor feeding terminal 17 and a portion in a complicated shape for resilient connection with the motor terminal 9*b* may be separately produced as the motor feeding conductor 12 and then attached to the casing, which simplifies the manufacture.

As in the foregoing, a throttle valve control unit according to the invention includes a container shaped casing, a rotation detection portion provided at the inner surface of the casing, a sensor terminal led from the rotation detection portion, exposed in a connector housing provided at the outer surface of the casing and held at the casing by insert-molding, a motor feeding terminal provided in parallel with the sensor terminal, having its one end exposed in the connector housing and held at the casing by insert molding, and its other end having an exposed part extended into the casing, and a motor feeding conductor provided separately from the motor feeding terminal and attached in the casing. One end of the motor feeding conductor is connected with the exposed part of the motor feeding terminal, and connected with a motor terminal as it is held between a pair of first folded portions provided at the other end of the motor feeding conductor. The motor feeding terminal is powered to drive a motor through the motor feeding conductor, the motor shaft of the motor rotates the throttle valve shaft to open/close the throttle valve, and the opening/closing angle of the throttle valve is detected based on the rotation transmitted to the rotation detection portion through the throttle valve shaft.

In this way, a throttle valve control unit that can easily be assembled and has a simple molding die structure can be provided.

A method of manufacturing a throttle valve control unit according to the invention includes the steps of:

forming a sensor terminal and a motor feeding terminal at a container shaped housing by insert-molding so that the terminals each have one end exposed in a tubular connector housing and the other end exposed at the inner surface of the casing, the container shaped housing having a storing portion storing the connector housing and a resistance substrate, storing the resistance substrate fixedly in the storing portion and connecting the resistance substrate to the other end of the sensor terminal, mounting a slider retainer provided with a slider member in the storing portion in a rotatable manner, the slider member sliding on the resistance substrate, fixing at the bottom of the casing a motor feeding conductor having a pair of first folded portions at one end and a second folded portion resiliently connected to the other end of the motor feeding terminal on the other end, thereby connecting the second folded portion to the other end of the motor feeding terminal, resiliently connecting a motor terminal to the first folded portion, and coupling a throttle valve shaft to the slider retainer.

According to the method, the motor feeding conductor separate from the motor feeding terminal is used, and therefore the molding die structure can be simplified.

What is claimed is:

1. A throttle valve control unit, comprising:

a container shaped casing; a rotation detection portion provided at the inner surface of said casing; a sensor terminal led from said rotation detection portion, exposed in a connector housing provided at the outer surface of said casing and held at said casing by insert-molding; a motor feeding terminal provided in parallel with said sensor terminal, having its one end exposed in said connector housing and held at said casing by insert molding, and its other end having an exposed portion extended into said casing; and a motor feeding conductor provided separately from said motor feeding terminal and attached in said casing, one end of said motor feeding conductor being connected with the exposed portion of said motor feeding terminal, and being connected with a motor terminal as it is held between a pair of first folded portions provided at the other end of said motor feeding conductor, said motor feeding terminal being fed to drive a motor through said motor feeding conductor, the motor shaft of said motor rotating the throttle valve shaft to open/close the throttle valve, the opening/closing angle of said throttle valve being detected based on the rotation transmitted to said rotation detection portion through the throttle valve shaft.

2. The throttle valve control unit according to claim 1, wherein one end of said motor feeding conductor is resiliently connected to said exposed portion by the second folded portion.

3. The throttle valve control unit according to claim 2, wherein a third folded portion is provided adjacent to said second folded portion, and the third folded portion is made into a bending portion formed between said second folded portion and an opposing wall.

4. The throttle valve control unit according to claim 3, wherein said casing is provided with a pair of guide columns having a recessed portion to support said pair of first folded portions.

5. A method of manufacturing a throttle valve control unit, comprising the steps of:

forming a sensor terminal and a motor feeding terminal, at a container shaped housing by insert-molding so that said terminals each have one end exposed in a tubular connector housing and the other end exposed at the inner surface of the casing, said container shaped housing having a storing portion storing said connector housing and a resistance substrate;

storing said resistance substrate fixedly in said storing portion and connecting said resistance substrate to said other end of said sensor terminal;

mounting a slider retainer provided with a slider member in said storing portion in a rotatable manner, said slider member sliding on said resistance substrate;

fixing at the bottom of said casing a motor feeding conductor having a pair of first folded portions at one end and a second folded portion resiliently connected to said other end of said motor feeding terminal at the other end, thereby connecting said second folded portion to said other end of said motor feeding terminal;

resiliently connecting a motor terminal to said first folded portion; and coupling a throttle valve shaft to said slider retainer.

* * * * *